US008490288B1

(12) United States Patent
Mollick et al.

(10) Patent No.: US 8,490,288 B1
(45) Date of Patent: Jul. 23, 2013

(54) FOLDING KNIFE BLADE WITH DUAL LOCKING MECHANISM

(76) Inventors: Mark Mollick, Phoenix, AZ (US); Paul Mollick, Phoenix, AZ (US)

( * ) Notice: Subject to any disclaimer, the term of this patent is extended or adjusted under 35 U.S.C. 154(b) by 143 days.

(21) Appl. No.: 12/931,488

(22) Filed: Feb. 1, 2011

Related U.S. Application Data

(63) Continuation-in-part of application No. 12/925,689, filed on Oct. 26, 2010.

(51) Int. Cl.
*B26B 1/02* (2006.01)
*B26B 29/02* (2006.01)

(52) U.S. Cl.
USPC ..... 30/161; 30/155; 30/158

(58) Field of Classification Search
USPC ..... 30/155–161; D8/98, 99, 101
See application file for complete search history.

(56) References Cited

U.S. PATENT DOCUMENTS

| | | | | | |
|---|---|---|---|---|---|
| 3,942,249 | A * | 3/1976 | Poehlmann | 30/160 |
| 4,120,088 | A * | 10/1978 | Phelps | 30/160 |
| 4,133,106 | A * | 1/1979 | Addis | 30/160 |
| 4,272,887 | A * | 6/1981 | Poehlmann | 30/161 |
| 4,541,175 | A * | 9/1985 | Boyd et al. | 30/161 |
| 4,670,984 | A * | 6/1987 | Rickard | 30/161 |
| 4,750,267 | A * | 6/1988 | Boyd | 30/161 |
| 4,901,439 | A * | 2/1990 | Boyd, Jr. | 30/161 |
| 5,755,035 | A * | 5/1998 | Weatherly | 30/161 |
| 5,822,866 | A | 10/1998 | Pardue | |
| 6,101,723 | A * | 8/2000 | Ford | 30/157 |
| 6,553,671 | B2 * | 4/2003 | Blanchard | 30/161 |
| 7,051,441 | B2 | 5/2006 | Carter, III | |
| 7,231,718 | B2 * | 6/2007 | Outen | 30/161 |
| 7,340,837 | B1 * | 3/2008 | Busse | 30/153 |
| 7,647,701 | B1 * | 1/2010 | Mollick et al. | 30/155 |
| 8,286,356 | B1 * | 10/2012 | Mollick et al. | 30/155 |
| 2009/0260234 | A1 * | 10/2009 | Lai | 30/161 |
| 2009/0277015 | A1 | 11/2009 | Duey | |
| 2011/0167647 | A1 * | 7/2011 | Gringer et al. | 30/156 |
| 2012/0023753 | A1 * | 2/2012 | Wen | 30/156 |
| 2012/0047746 | A1 * | 3/2012 | Caswell | 30/161 |
| 2012/0324738 | A1 * | 12/2012 | Chu et al. | 30/160 |

* cited by examiner

*Primary Examiner* — Andrea Wellington
*Assistant Examiner* — Omar Flores Sanchez
(74) *Attorney, Agent, or Firm* — Thomas W. Galvani, P.C.; Thomas W. Galvani

(57) ABSTRACT

A locking mechanism for a folding knife. The locking mechanism has a locking sleeve and an opposed locking bolt which are coaxial and biased to a locking position by a spring. In the locked position, either with the blade extended or folded, both a lug on the bolt and a surface on the sleeve engage a locking surface on the blade tang area. Simultaneous manual force must be applied by the user to oppositely release buttons on the opposite handles to move both the locking bolt and locking sleeve to positions to disengage them from the locking surface to allow the blade to be folded or unfolded.

10 Claims, 8 Drawing Sheets

FOLDING KNIFE BLADE WITH DUAL LOCKING MECHANISM

CROSS-REFERENCE IS MADE TO RELATED APPLICATION

This application is a continuation-in-part of U.S. patent application Ser. No. 12/925,689, filed Oct. 26, 2010, of the same title.

FIELD OF THE INVENTION

The present invention relates to knives and more particularly to folding blade knives having a locking mechanism for locking the blade in either the retracted or extended position.

BACKGROUND OF THE INVENTION

Folding knives are well known and generally are constructed having a handle which may incorporate liners. A blade is pivotally secured to the forward end of the handle generally by a pivot pin extending through the tang area of the blade. In the retracted position the blade is positioned within the handle between the liners with the sharpened edge in a protected or sheathed position. In the retracted position, the knife may be more safely carried or handled.

When it is desired to use the knife, the blade is pivoted to a position extending forwardly from the handle. The blade is manually pivoted by the user to the open position sometimes with the assistance of a finger notch near the spine of the blade.

In order to enhance the safety of folding knives, various locking arrangements have been proposed in the prior art. Many of these arrangements utilize a single button or slide which is actuated or depressed to displace a locking pin or element to allow the blade to be folded either to the extending or retracted position. However, many of these locking arrangements are complex, not lending themselves to incorporation in current folding knives designs and are subject to accidental release. Further, many prior art folding knife locking mechanisms are aesthetically objectionable particularly with many specialty and expensive custom knives.

BRIEF SUMMARY OF THE INVENTION

The present invention relates to a dual locking mechanism for a folding knife. The mechanism has a pair of opposed locking elements or members. One of the locking members has a release button or head extending through a bore in one of the handles. The other locking member has a release button or head which extends through a bore in the opposite handle. The locking members are co-axial. One locking member comprises a locking bolt having a cylindrical body having a pair of spaced-apart lugs defining an intermediate groove between the lugs. The opposite locking member comprises a locking sleeve defining an axial slot along its surface. The axial slot has an enlarged section in an intermediate location. The locking bolt is slidable within the body of the locking sleeve.

A spring intermediate the locking member applies a separating, biasing force to the two locking members. The edge of the tang of the knife blade defines a pair of opposed, arcuate recesses for locking the blade in the folded and unfolded positions. A seat is located within each of the recesses. One of the lugs of the locking bolt engages one of the seats in one of the locked positions. In a locked position, a stop surface on the body of the locking sleeve engages the tang surface adjacent the locking recess. The locking members are normally urged or biased to the locked position by the spring.

To unlock the blade from either the extended, locked position, or the blade retracted, locked position, a user must apply a manual inward force simultaneously to both of the locking members using the release buttons in the opposed knife handles. The applied manual force will overcome the spring bias, moving the locking members toward a central position with the groove of the locking bolt member and the wide slot of the surface of the locking sleeve in alignment with each other and also with the tang area of the blade. In this position, the blade is unlocked and may be folded or unfolded as long as the manual unlocking force is maintained on both members. When the manual force is released, the locking members, due to the spring force, will be urged to their locked positions, engaged in one of the locking recesses and associated seat in the blade tang when the blade is in either the folded or unfolded position.

In another embodiment of the dual locking mechanism for a folding knife blade according to the present invention, the blade pivots around a slotted hub in which opposed locking bolts are slidably received. The bolts are biased by a spring in opposite directions and, in a locked position, lugs or projections on the bolts are concurrently held in engagement with locking notches in the blade and recesses in the handle, locking the blade. Manual force applied simultaneously by the user to the release buttons or the bolts will cause the lugs to disengage from the blade locking notches.

The safety locking mechanism with opposed dual locking members is adaptable to a wide range of folding knives and an aesthetically acceptable safety feature.

BRIEF DESCRIPTION OF THE DRAWINGS

The above and other advantages and objects of the present invention will become more apparent when taken in conjunction with the following description, claims and drawings in which:

DETAILED DESCRIPTION OF THE DRAWINGS

Figure 1:
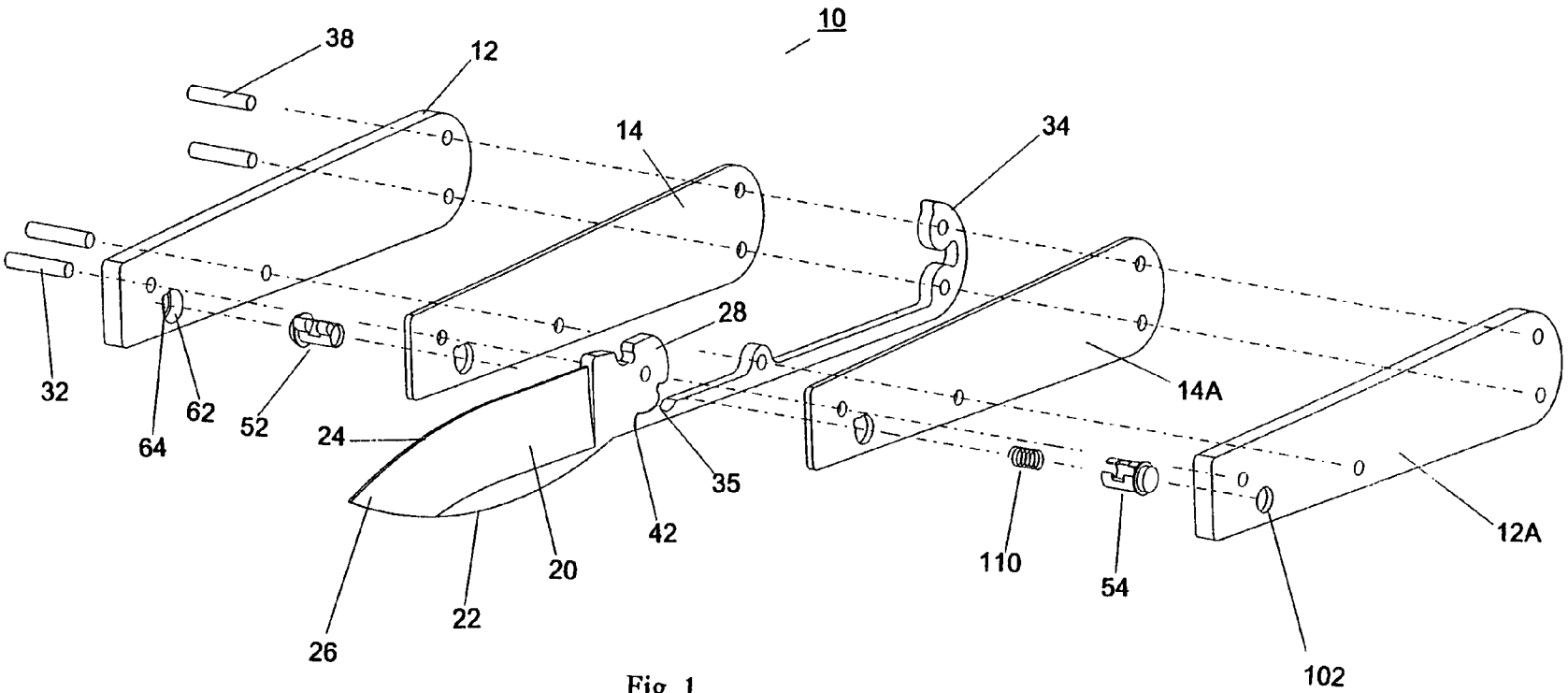
FIG. 1 is an exploded view of a representative folding knife incorporating the dual locking mechanism of the present invention with the blade shown in an open position.

Turning now to the drawings, particularly FIG. 1, which shows a representative folding knife construction of the type to which the dual locking mechanism of the present invention may be applied. As mentioned above, folding knives may have different shapes and dimensions and it will be understood that the following description with reference to FIG. 1 is a general description of a representative folding knife for background and to facilitate an understanding of the present invention.

It will be appreciated that the locking mechanisms of the present invention may be applied or incorporated into a wide range of folding knife styles, shapes and sizes.

Folding knife 10 has opposite handles 12 and 12A. The handles 12 and 12A may be any suitable material and include suitable decoration. Liners 14, 14A are respectively positioned at the inner sides of the handle. Blade 20 is interposed between the liners. The blade 20 has a back 22, sharpened edge 24, tip 26 and a rear tang area 28. The blade 20 is pivotal between an open and a closed position at pin 32 which extends between the handles. A spacer 34 extends between the liners for the purpose of providing a space for the blade to fall into when the blade is closed. The knife assembly is secured by a plurality of rivets or fasteners 38.

Figure 2:
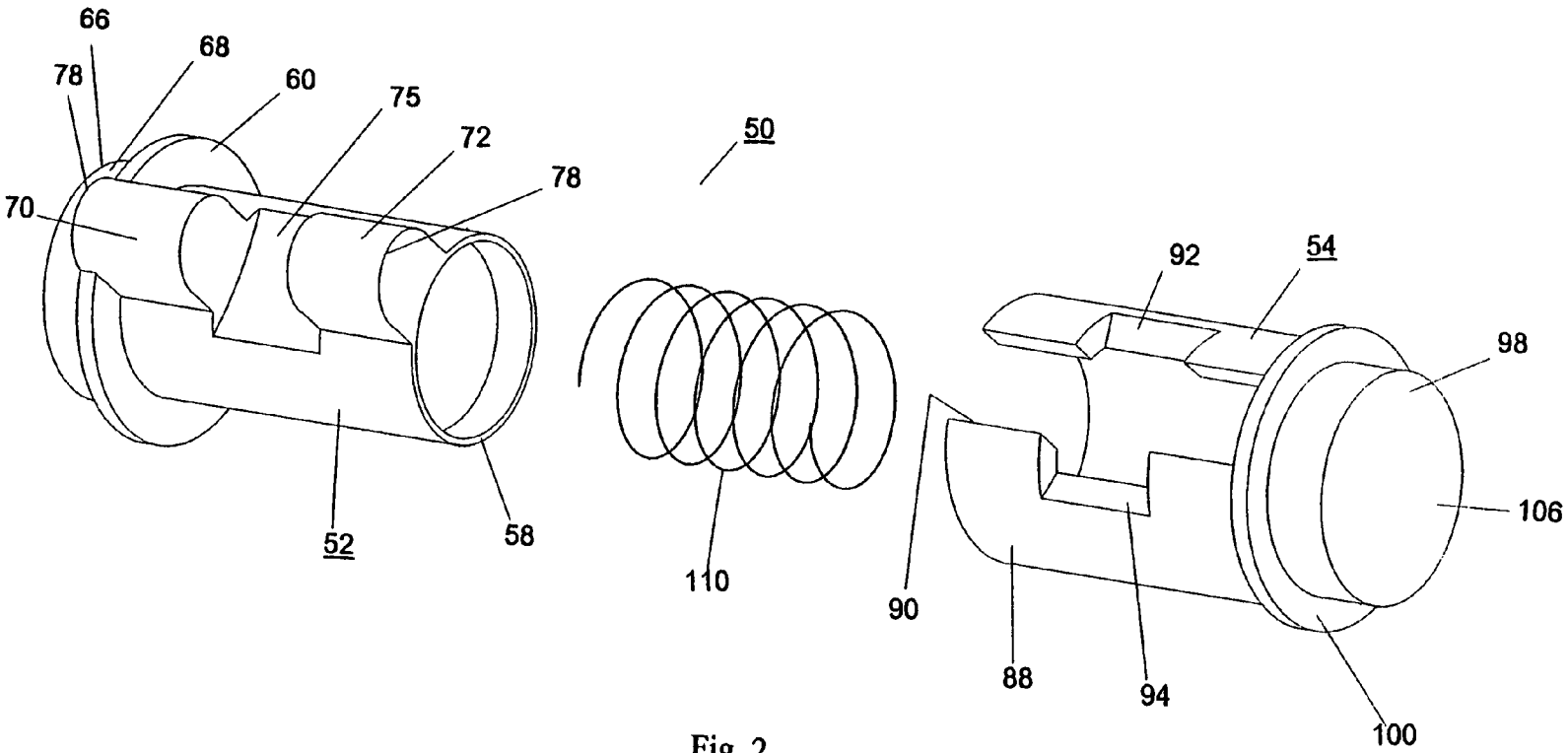
FIG. 2 is an enlarged, exploded view of the dual locking mechanism seen in FIG. 1.

The locking mechanism 50 seen in FIGS. 1 and 2 includes two locking elements 52, 54. Locking element 52 is a bolt having a generally cylindrical body 58 which extends to a location intermediate the liners. The outer end of the body 58 carries a collar 60 which seats in a recess 62 on the inner side of handle 12. A release button 68 extends through bore 64 having a surface 66 which is substantially flush with the outer surface of handle 12. A manual actuating force is applied to the surface of the release button 68 to depress the locking bolt 52 and move it to an unlocked position.

Bolt 52 has a pair of spaced-apart lugs 70, 72 separated by an intermediate groove 75. The lugs each project from the body of the bolt having a curved or arcuate upper surface 78. The width of groove 75 is slightly greater than the width of the tang area of the blade 20.

The opposite locking member 54 has a sleeve-like body 88. The axis of the interior of the body 88 is aligned with the axis of bolt 52 and is sized to allow the locking bolt 52 to reciprocate within the body of the sleeve.

The body 88 of the locking sleeve has an axial slot 90 extending along its surface and aligned with lugs 70, 72. The opposite sides of the slot 90 each have enlarged cut-out sections 92, 94 formed at an intermediate location. The outer end of the body 88 carries an annular collar 100 which seats in a recess 102 on the inner side of the handle 12A. A release button 98 extends through a bore within the recess 102. The release button 98 has a surface 106 which is substantially flush with the outer surface of the handle 12A.

Manual force is applied to the surface 106 to inwardly depress the locking sleeve 54 to move it to an unlocked position. As will be explained, unlocking of the blade can only occur if both the locking bolt and locking sleeve are simultaneously depressed, bringing both to an unlocked position. The locking members are biased outwardly to a normal locked position by spring 110 which is housed in the interior of the sleeve and bolt, applying an outward force to both members.

Figure 3:
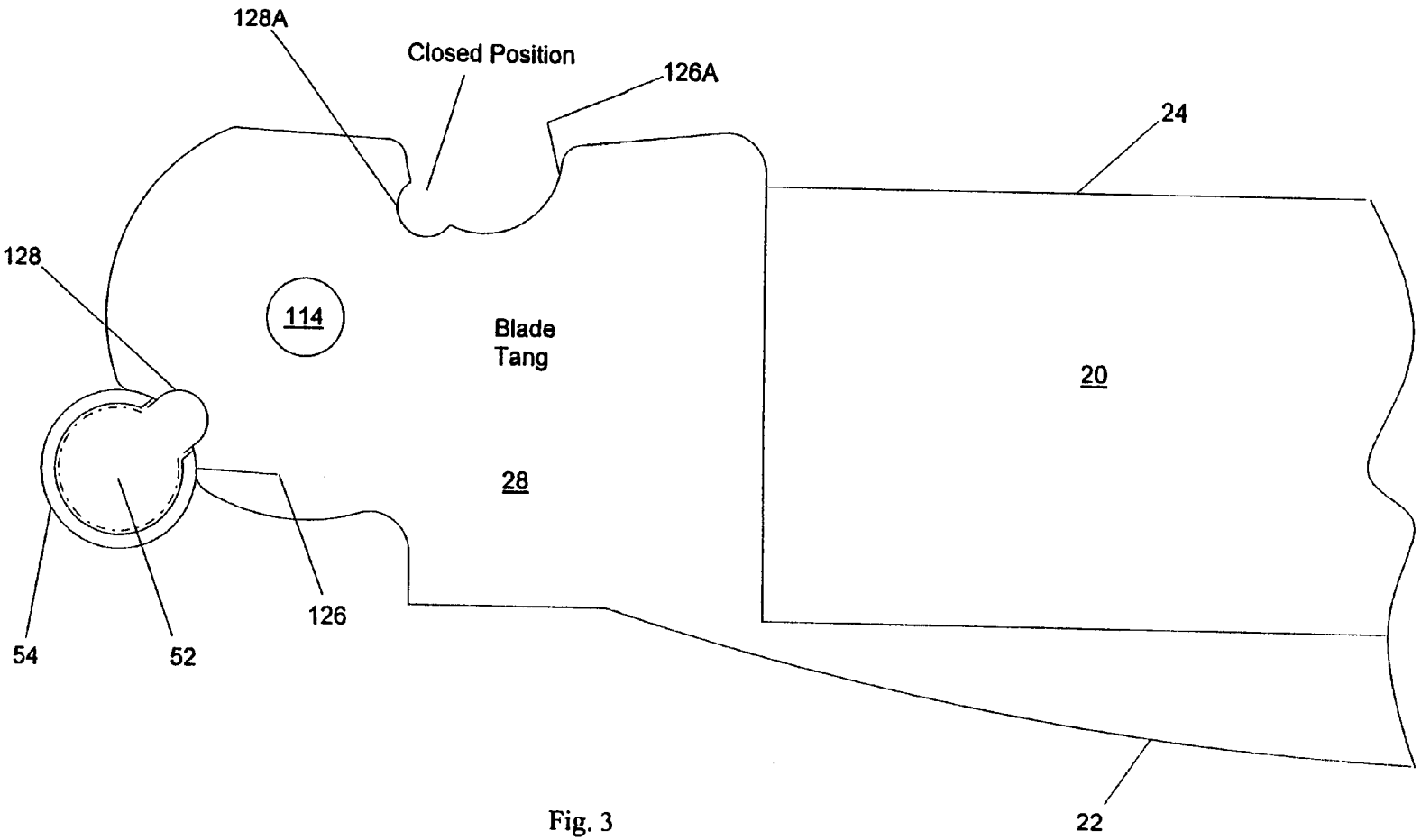
FIG. 3 is a side view of the tang area of the folding knife blade showing the dual locking mechanism engaging the tang to secure the blade in a locked, open position.

Referring to FIG. 3, a portion of the blade 20 and the tang area 28 are shown with the blade locked in an open or unfolded position. The tang area has a bore 114 to receive a pivot pin 32 as described above. The area of the tang 28 on the spine 22 of the blade 20 has an arcuate recess 126 having a curvature conforming to the curvature of the outer surface of the sleeve 54. A seat 128 is defined at a location along the recess and is configured to receive the curved upper end of lug 72 on the locking bolt. The recess 126 and seat 128 engage the locking elements to secure the blade in the open position.

A recess 126A is located generally diagonally opposite recess 126, again having a curvature conforming to the curvature of the outer surface of the locking sleeve. A seat 128A is defined at a location along the recess to receive the curved, upper end of lug 72 in the locked position. The recess 126A and seat 128A in the tang area engage the locking members to maintain the blade in the closed position.

Figure 2B:
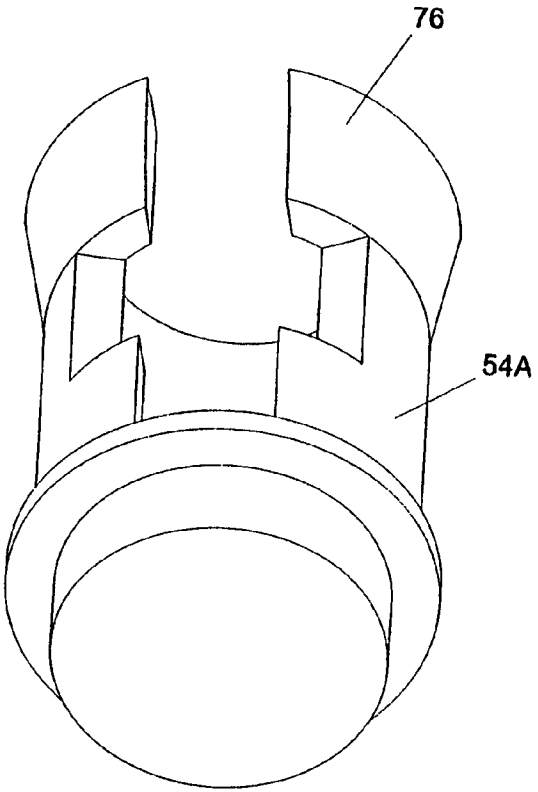
FIGS. 2A and 2B show alternate embodiments of the locking mechanism seen in FIG. 2.
Figure 2A:
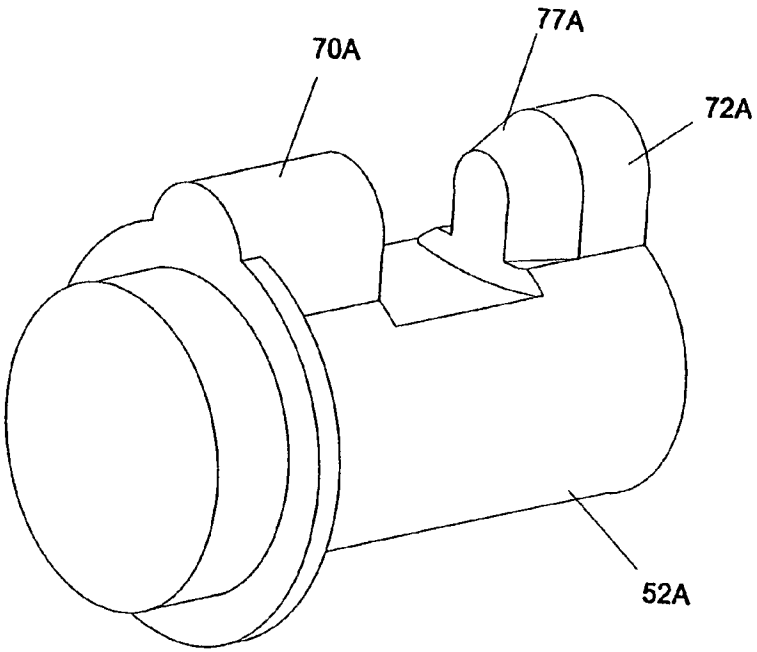

In FIGS. 2A and 2B, alternate embodiments of the locking mechanisms are shown. Locking bolt 52A has been previously described having a body with projecting lugs 70A and 72A. The inner edge of lug 72A is chamfered at 77A to facilitate seating and unseating from the blade tang area.

Similarly, in FIG. 2B the locking sleeve 54A is as described above, but the body has an inner end flared at 76 to facilitate entry and reciprocation of the locking sleeve within the blade.

The present invention will be better understood from the following description of operation:

Operation

When the blade 20 is in the open position with the blade extended and without the user applying a manual force to unlock the blade, the blade is locked by engagement with both the locking bolt 52 and locking sleeve 54. FIG. 3 shows the blade locked in the open position with the curved recess 126 engaged by the sleeve 54 and the seat 128 engaged by lug 72 on the locking bolt 52.

Figure 4:
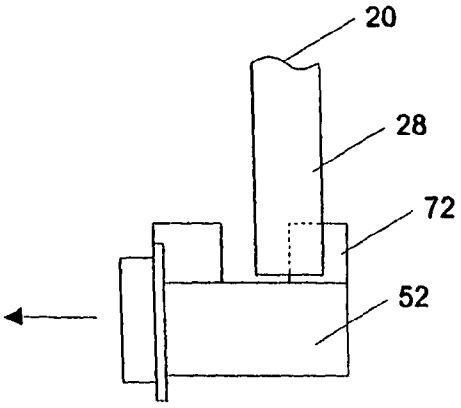
FIG. 4 shows the position of the locking bolt in a normal blade locking position, the second locking sleeve being omitted for purposes of clarity.

FIG. 4 is a simplified view of the locking bolt 52 and the tang area 28 of the blade 20. The arrow indicates the direction of the spring force bias which normally urges the locking bolt to the engaged position shown in FIG. 4. Note the locking sleeve 54 is not shown in the FIG. 4 view. Lug 72 engages one of the seats 128, 128A in the tang area of the blade, as seen in FIG. 3, depending on the position of the blade.

Figure 5:
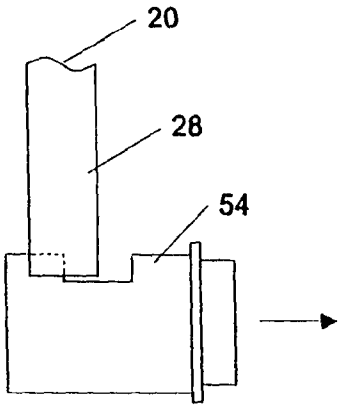
FIG. 5 shows the position of the locking sleeve in a normal blade locking position, the locking bolt being omitted for purposes of clarity.

Referring to FIG. 5, the position of the locking sleeve 54, when engaged to secure the blade in a locked position, is shown. The arrow indicates the direction of the spring force bias. A section of the curved surface of the body of the sleeve adjacent its inner end is in engagement with one of the curved recesses 126, 126A, as also seen in FIG. 3.

Figure 6:
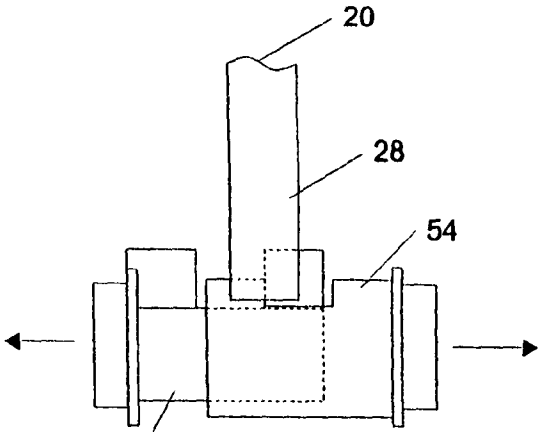
FIG. 6 shows both the locking sleeve and bolt in a normal locking position.

In the normal blade locking position, the biasing spring 110 urges both the locking sleeve and the locking bolt into locking positions engaging the tang area of the blade. FIG. 6 shows the relative position of both the locking bolt 52 and locking sleeve 54 in a locked position. In the blade open position, the locking bolt and locking sleeve are engaged as described above with reference to FIG. 3 and in the opposite seat and recesses 126A, 128A in the closed, locked position.

When the user wishes to unlock the blade to either fold or unfold the blade, the user will simultaneously apply a manual unlocking force to both of the opposed release buttons 68, 98 on the handles 12, 12A.

Figure 7:
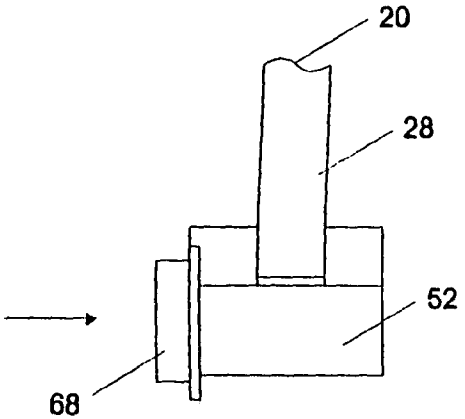
FIG. 7 shows the locking bolt moved to an unlocked position, the opposite locking sleeve being omitted for purposes of clarity.

In FIG. 7, the arrow indicates the direction of the unlocking force applied to the release buttons which force opposes the bias of spring 110, moving the locking bolt 52 to a position in which the groove 75 is aligned with the blade. The unlocking force applied to the locking sleeve 54 moves the sleeve to a position in which the enlarged slot areas 92, 94 are aligned with the blade and the groove 75 in the bolt.

Figure 9:
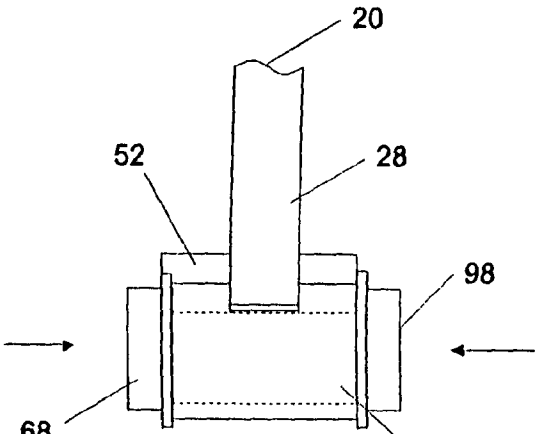
FIG. 9 shows the cooperating dual locking sleeve and bolt both being moved to an unlocked position relative to the knife blade.
Figure 8:
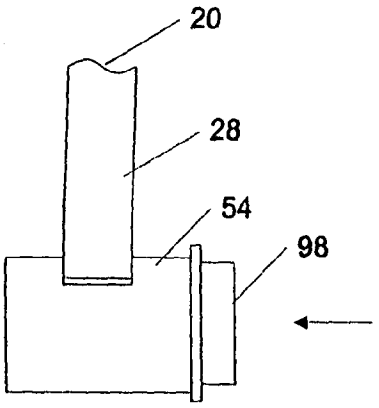
FIG. 8 shows the locking sleeve moved to an unlocked position, the opposite locking bolt not being shown for purposes of clarity.

FIG. 8 shows the sleeve 54 in the unlocked position and FIG. 9 shows both the locking sleeve and bolt in their unlocked positions, out of engagement with the recess and seat in the blade tang area. The blade can now be pivoted to an extended or folded position. Once the blade is moved to either of these positions, the locking members will return to their locked positions engaging one of the recesses and seats in the tang area. The reciprocal engagement of the locking bolt within the locking sleeve also prevents the members from rotating.

The opposed, dual locking members are both safe and convenient. There is a significantly lessened chance of the user unlocking the blade as both locking elements must be simultaneously actuated. Incidental force applied to only one of the locking elements will not unlock the blade. Further, the members are versatile as they lend themselves to use by both right- and left-handed individuals.

Figure 10:
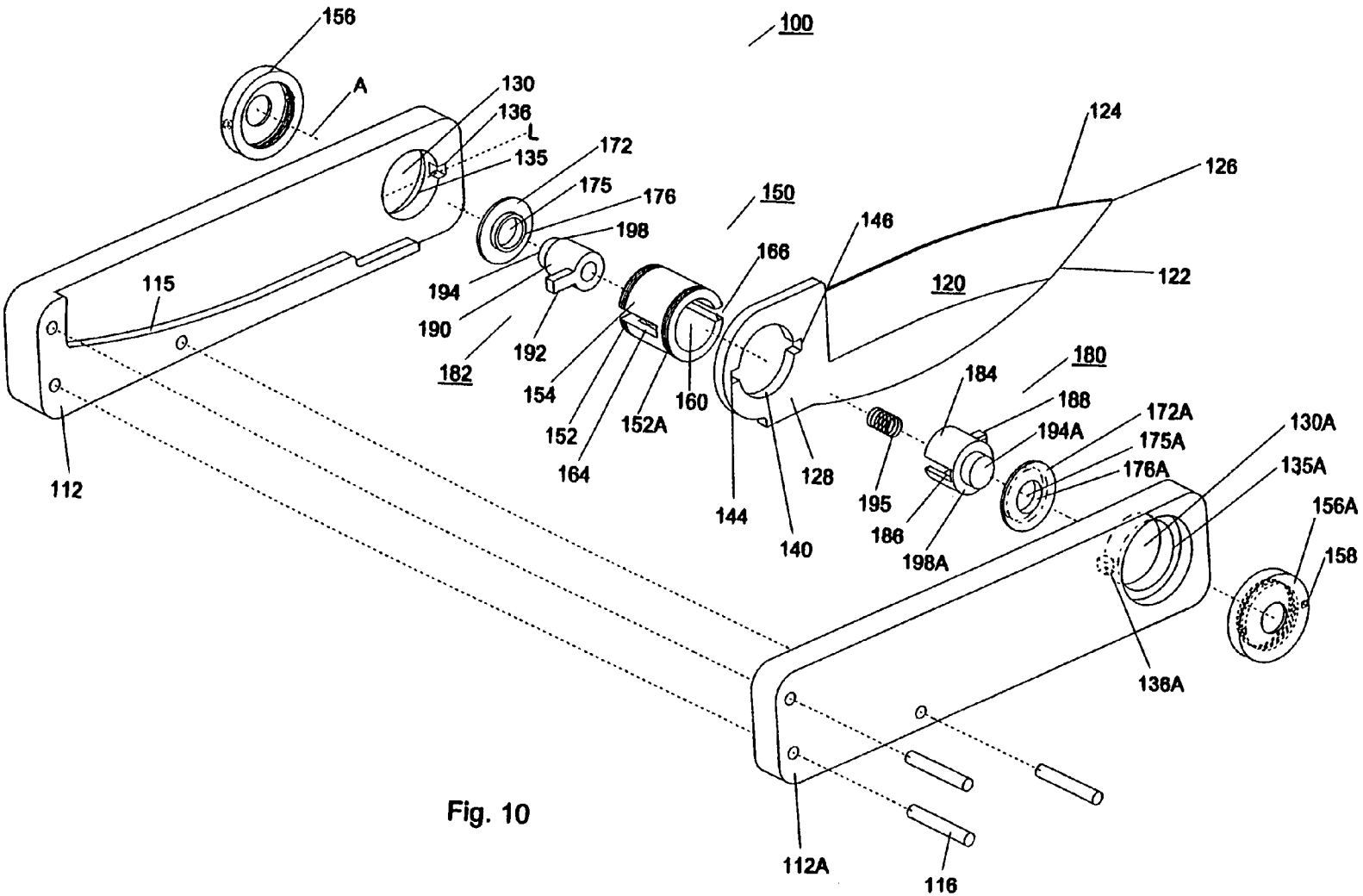
FIG. 10 is an exploded view of an alternate embodiment of a dual locking mechanism for a folding knife blade.

An alternate embodiment of a dual locking mechanism for a folding knife is shown in FIG. 10 and generally designated by the numeral 100 in which similar elements are identified with the same numeral and distinguished by an appended letter "A." Knife 100 has opposite handles 112 and 112A. Handle 112 has a longitudinal recess 115 on its inner surface which receives blade 120 in the closed or folded position. The knife may also include liners which are not shown. The handles are secured by suitable fasteners such as pins 116.

The blade 120 has a back 122, sharpened edge 124, tip 126 and tang area 128 opposite the tip. The forward ends of the handles 112, 112A, each define circular openings 130, 130A, each opening having interior annular shoulders 135, 135A. Recesses 136, 136A, respectively, extend axially inwardly from the inner surface of the handles 112, 112A of the associated openings 130, 130A. The recesses are oppositely arranged with recess 136 forwardly extending and recess 136A rearwardly extending and both being radial on a longitudinal diametrical line L extending through the center of the openings 130, 130A which allows the blade 180° of rotation between the closed and open positions. The recesses extend from the inner surface of the associated handle to a depth adjacent shoulders 135, 135A.

Blade 120 defines a circular pivot opening 140 in the tang area 128. The opening 140 has locking notches 144, 146, which correspond to recesses 136, 136A. In the open position, locking notch 144 aligns with recess 136A and notch 146 aligns with recess 136. In the blade closed and locked position, the alignment of the locking notches and recesses is reversed.

The blade 120 rotates about fixed cylindrical hub 150. Hub 150 has a bearing surface 154 which is received within pivot opening 140 in the blade allowing the blade to rotate about the hub between open and closed positions. The opposite threaded ends 152, 152A of the hub extend into the openings 130, 130A in the handles and are held in place by internally threaded end caps 156, 156A. The end caps may be tightened by a tool having pins which engage opposed apertures 158 in the caps, or the caps may be secured by pins or setscrews.

Cylindrical hub 150 has a hollow, cylindrical interior 160. Axial slots 164, 166 extend partway in the hub sidewalls from opposite ends of the hub. Slot 164 aligns with recess 136A and slot 166 aligns with recess 136. The opposite ends of the hub receive bushings 172, 172A which have a flange extending into bore 160 to reinforce hub 150 and maintains its cylindrical shape. The bushings define central openings 175, 175A around which extend annular flanges 176, 176A, respectively.

The dual locking mechanism of FIG. 10 will normally lock the blade in a selected open or closed position. The locking mechanism is released by simultaneous application of manual force to locking bolts 180, 182. Bolt 180 has a cylindrical sleeve or body 184 having a concentric release button 194A on its outer end that extends through the bushing 172A into the central bore in end cap 156A. Slot 186 in the sidewall of the bolt 180 and slot 164 in hub 150 are positioned to align with locking lug 192. Lug 192 aligns with notch 144, slot 164 and recess 136A in the locked open position, as seen in FIG. 10. When the blade 120 is released and manually rotated to the closed position, lug 188 on bolt 180 will align with notch 144, slot 166 and recess 136 in handle 112.

The cylindrical body 190 of bolt 182 is sized to reciprocate within the body 184 of opposite bolt 180. Lug 192 is on the inner end of bolt 182 and aligns with blade notch 144 in the open blade position and with locking notch 146 when the blade is rotated to the closed position. A release button 194 extends into the opening in the bushing 172 and through end cap 156. Spring 195 is seated within the blind end of bolt 180 and abuts the inner end of bolt 182, applying an outward biasing force to both bolts 180, 182, normally urging them toward a locking position. The bolts, blade, hub, bushings and handle openings are all coaxial along axis A.

With the blade 120 in a closed position seated within the handle recess 115, the blade is held in a locked position by locking lugs 188, 192. In the closed and locked position, locking lug 188 on bolt 180 engages locking notch 144 in the blade opening which has been rotated 180° from its position, as shown in FIG. 10, and is also partway seated in recess 136 in opening 130 in handle 112.

The locked position of the lugs concurrently engaging both a blade locking notch and a recess in the handle is established by a stop or abutment such as stop shoulders, 198 and 198A on the bolts. In locked positions, shoulder 198 on bolt 182 engages the flange 176 of bushing 172 which is seated against the end cap 156 in bore 130. Bolt 180 is similarly outwardly biased and held in a locked position, concurrently engaging a blade locking notch and recess 136. The depth of the engagement of the bolt lugs with their associated recesses 136, 136A is established by the stop shoulders.

To unlock the blade from either an extended or closed, locked position, a user must simultaneously apply an inward, manual force to both bolts 180, 182 by application of inward force to release buttons 194, 194A. This force will overcome the outward force or bias of spring 195, causing the lugs on bolts 180, 182 to move out of engagement with the associated blade locking notch (either 144 or 146, depending on the blade position) and further into the associated recesses 136, 136A in the handles. This disengagement from the blade locking notch will release the blade and once the blade has been rotated to a position in which the locking lugs are again aligned with a blade notch, the lugs will, under the force of spring 195, engage the aligned blade notch to lock the blade in the selected position.

With some knife designs due to the shape of the handle and handle recess relative to the blade, it may be necessary to limit blade rotation to less than 180°. The desired blade rotation can be selectively established by adjustment of the position of the blade locking notches, hub slots and handle recesses.

Figure 13:
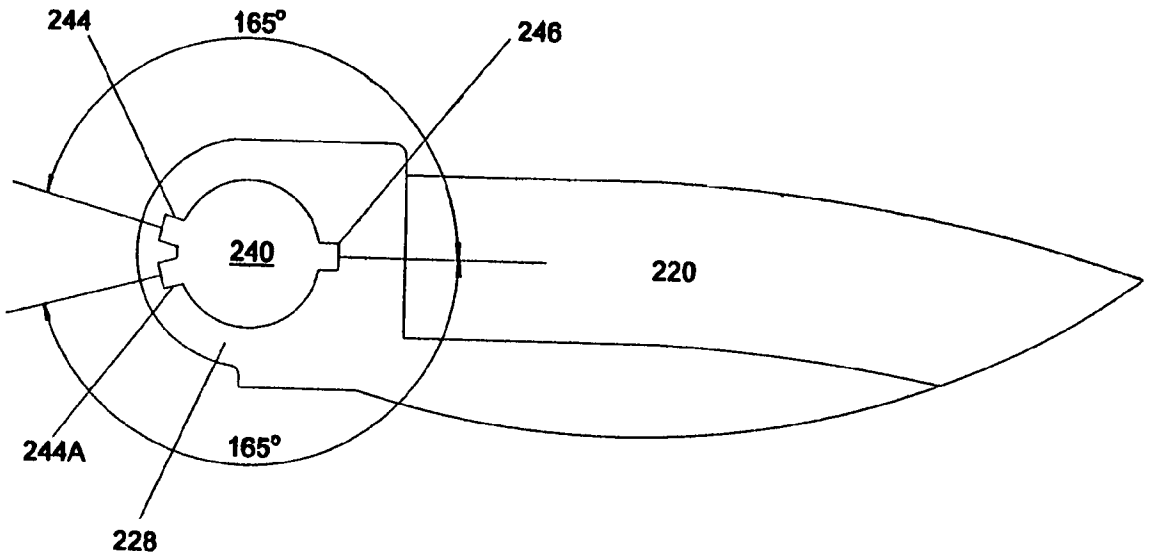
FIG. 13 is a plan view of a blade modified for use with the hub shown in FIG. 12.
Figure 12:
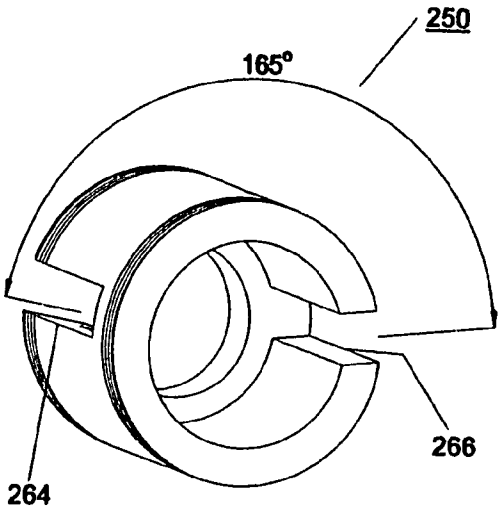
FIG. 12 is a perspective view of a modified hub for a folding knife blade having a dual locking mechanism in which the blade is rotatable less than 180° to about 165°.

FIG. 13 is a plan view of a blade 220 of a folding knife having a tang area 228 which defines a circular opening 240 which allows the blade to rotate about a fixed hub 250 seen in FIG. 12. Blade 220 is modified having a pair of notches 244, 244A in the blade opening, each a selected angular distance, in this case 165°. The lugs 188 and 192 on the bolts are positioned to reciprocate within slots 264 and 266, respectively. The locking recesses in the handles are also positioned apart according to the desired rotation, 165°.

The operation of the dual locking mechanism incorporating the blade and hub features of FIGS. 12 and 13 is as has been described with reference to FIG. 10. The blade 220 is held in the open position by engagement of locking notches 244 and 246 with the locking lugs, which are also seated in the locking recesses in the handles. When the blade 220 is rotated 165° to the closed position, the notches 246 and 244A now align with the locking lugs on the bolts and the associated recesses in the opposite handle to lock the blade.

Figure 11:
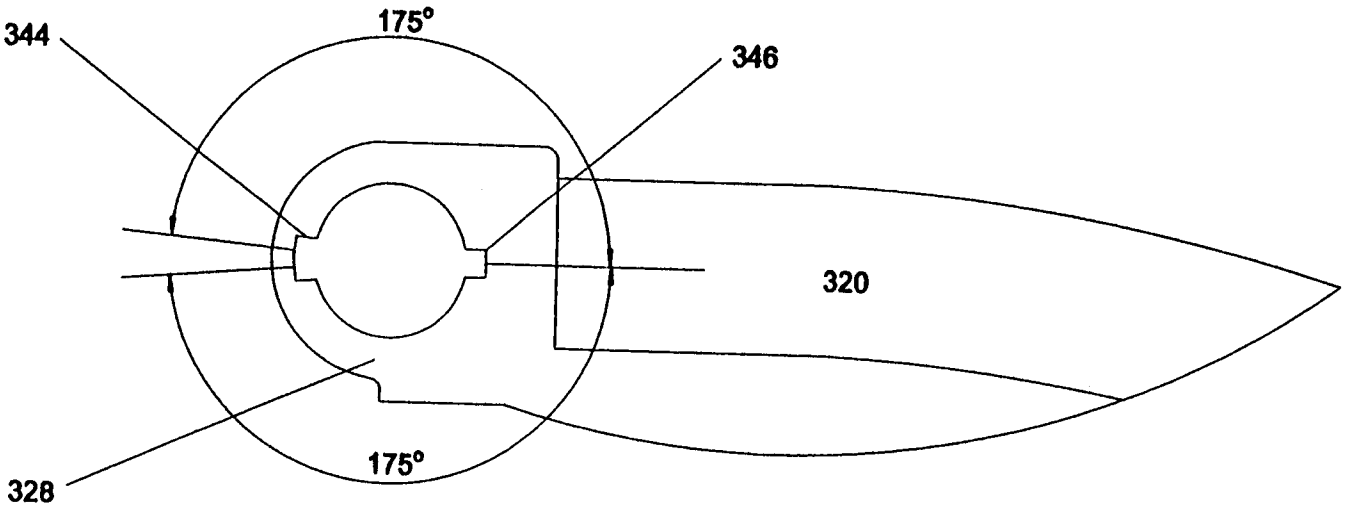
FIG. 11 is a plan view of a blade of a folding knife blade as seen in FIG. 10 modified so that the blade may rotate approximately to a 175° open position.

If a blade rotation of less than 180° is required, a single enlarged radial locking notch 344 in the tang area 328 of blade 320, as seen in FIG. 11, may, in some instances, be employed opposite notch 346 instead of a pair of adjacent locking notches as shown in FIG. 13. The alignment and orientation of the outer components, such as the hub slots, locking lugs, locking recesses would be modified according to the angular relationship of the blade locking notches.

It will be apparent that the blade rotation angle may be established by selective positioning of the locking notches and other components as described above.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. A knife having a blade with folded closed and open positions, said folding knife comprising:

(a) a blade having a tang area defining a pivot opening, said opening having generally opposed first and second locking notches;

(b) first and second handles defining an area therebetween for receiving the blade in the closed position, said first handle defining a first bore having a first locking recess and said second handle defining a second bore having a second locking recess;

(c) a hollow pivot hub axially extending between the first and second bores in said handles and through the blade pivot opening supporting pivoting of the blade between a closed position in the area between the handles and an open position extending forwardly from the handles;

(d) a first bolt reciprocable within said hub, said first bolt having a first locking lug disposed between the blade and the second handle aligned with said second recess, said first lug aligned with said first locking notch in the blade open position and aligned with the second locking notch in the blade closed position;

(e) a second bolt reciprocable within said hub, said second bolt having a second locking lug between said blade and the first handle aligned with said first recess, said second lug aligned with said second locking notch in the blade open position and aligned with the first locking notch in the blade closed position;

(f) biasing means applying a biasing force urging said first bolt into a locking position in concurrent engagement with the second recess in the second handle and with a selected one of locking notches in the blade, said biasing means applying a biasing force urging said second bolt into a locking position in concurrent engagement with the first recess in the first handle and with a selected one of the locking notches in the blade; and (g) release means associated with each of said bolts, said release means moveable by manual force applied simultaneously to both said release means to move the first and second locking lugs to an unlocked position into their associated recesses in the handles and out of engagement with the associated blade locking notches.

2. The knife of claim 1 having a blade with folded closed and open positions wherein the hub has oppositely threaded ends which are engaged with first and second end caps on said first and second handles.

3. The knife of claim 1 having a blade with folded closed and open positions wherein the first and second locking notches are oppositely positioned at approximately 180°.

4. The knife of claim 1 having a blade with folded closed and open positions wherein the hub defines opposite first and second slots and said first lug is slidable in said first slot and said second lug is slidable in said second slot.

5. The knife of claim 1 having a blade with folded closed and open positions wherein the lugs are spaced-apart at a selected angle less than 180° and the notches in the blade, slots in the hub and recesses in the handles are positioned in alignment with the lugs at said selected angle.

6. The knife of claim 1 having a blade with folded closed and open positions including stop means for maintaining the lugs in a locked position concurrently engaging both the associated recesses in the handles and blade locking notches.

7. The knife of claim 1 having a blade with folded closed and open positions wherein the first bolt is reciprocable within a bore in the second bolt.

8. The knife of claim 1 wherein the release means comprise opposed buttons on said first and second handles aligned on a common axis.

9. The knife of claim 1 wherein the blade opening has locking notches in addition to said first and second locking notches.

10. The knife of claim 1 wherein said first and second locking notches extend in the peripheral edge of the opening and wherein the first locking notch has a width dimension along the peripheral edge which is greater than the corresponding width dimension of the second notch.

* * * * *